United States Patent [19]

Yates et al.

[11] Patent Number: 5,060,338

[45] Date of Patent: Oct. 29, 1991

[54] WET MOP WITH SELF-CONTAINED WRINGER

[75] Inventors: James P. Yates, Casey, Ill.; Enzo Berti, Mirano, Italy

[73] Assignee: The Libman Company, Arcola, Ill.

[21] Appl. No.: 509,135

[22] Filed: Apr. 16, 1990

[51] Int. Cl.[5] ..... A47L 13/144

[52] U.S. Cl. ..... 15/119 A; 15/105; 15/262

[58] Field of Search ..... 15/119 R, 119 A, 116.1, 15/116.2, 262

[56] References Cited

U.S. PATENT DOCUMENTS

| | | | |
|---|---|---|---|
| 1,709,622 | 4/1929 | Justis | 15/120 A |
| 2,521,445 | 9/1950 | Brown | 15/119 |
| 3,364,512 | 1/1968 | Yamashita et al. | 15/260 |
| 3,462,788 | 8/1969 | Abbott | 15/119 |
| 3,946,457 | 3/1976 | Robinson | 15/119 R |
| 4,809,387 | 3/1989 | Nakamura et al. | 15/119 R |

FOREIGN PATENT DOCUMENTS

| | | | |
|---|---|---|---|
| 3607121A1 | 9/1987 | Fed. Rep. of Germany . | |
| 7966 | of 1908 | United Kingdom | 15/119 R |
| 593452 | 10/1947 | United Kingdom | 15/116.1 |

*Primary Examiner*—Chris K. Moore

*Attorney, Agent, or Firm*—Marshall, O'Toole, Gerstein, Murray & Bicknell

[57] ABSTRACT

A wet mop with a mop handle having top and bottom ends; a plurality of fibrous strands comprising a mop body for cleaning a surface; the mop body being attached to the mop handle bottom end; a sleeve in the form of a tubular shell, for squeezing water from the mop body by sliding the shell downward along the handle and over and around the mop body, axially and slidably mounted on the mop handle upward of the mop body; the tubular shell having an open lower end and a closed upper end; the tubular shell including a frusto conical shell portion tapering inwardly from about the shell lower end portion for at least a major portion of the shell length; the frusto conical shell portion having a group of axially positioned inwardly directed grooves equally spaced apart around the shell periphery; each groove of the group having a bottom, with the bottom of most of the grooves being substantially straight and parallel to the shell axis; and each groove of the group extending for at least a substantial portion of the frusto conical shell portion.

21 Claims, 6 Drawing Sheets

WET MOP WITH SELF-CONTAINED WRINGER

This invention relates to surface cleaning mops which utilize a mop body made of strands as distinguished from sponge mops. More particularly, this invention pertains to an improved surface cleaning mop of the type which includes a self-contained mop body wringing tube slidably mounted on a mop handle.

BACKGROUND OF THE INVENTION

Mops have been used for a long time to clean surfaces such as floors in institutions, industrial plants and private homes and apartments. Special mops have been developed for home and apartment cleaning which are easily handled and highly efficient for the generally light duty cleaning therein involved.

One type of mop which is highly suitable for home and apartment floor cleaning includes a tube or sleeve, mounted on a mop handle, which can be slid over a mop head or body made of fibrous strands to wring or compress water therefrom. Mops of this general type are disclosed in U.S. Pat. Nos. 1,709,622; 3,364,512; 3,946,457; and 4,809,287; and German published patent application No. DE 3607121 A1.

The German published patent application discloses a mop of the described type which has a sleeve with three integral and identical grooves or ribs axially positioned and equally spaced apart about 120°. Actual examination and testing of a commercial mop having this form of sleeve has established that it retains much more water after wringing than is desirable for final rinse mopping and drying. Also, sliding the sleeve over the mop head is more difficult than desirable and apparently, in part, this is because the grooves extend radially inward more at the lower end of the sleeve than upward towards the middle of the sleeve. Also, the sleeve has a lower cylindrical end about two inches long from which the sleeve tapers inwardly for four inches and ends in an upper cylindrical portion about five inches long but with an outside diameter of 4.38 inches, which is larger than readily gripped by the hands of many persons. The sleeve cylindrical lower end makes it difficult to slide the sleeve over the mop head to squeeze out water and to subsequently withdraw the sleeve from the mop head.

The Justis U.S. Pat. No. 1,709,622 listed above discloses a wet mop of the described type which includes a tapered sleeve which has a flared lower end or mouth. The sleeve has four equally spaced apart identical axial short and shallow grooves. These grooves appear to have a uniform depth and to follow the contour of the sleeve taper and flare. The bottom of each groove is thus not close to being parallel to the mop handle. Furthermore, the diametrical distance between the bottoms of each pair of opposing grooves is much greater than desired to achieve proper wringing with such shallow grooves.

From the above discussion it is clear that a need exists for a wet mop of the described type which incorporates a sleeve which readily and easily expresses sufficient water from the mop head so that it can be used for a final rinsing and drying of a mopped surface. This and other needs are met by the subsequently described invention.

SUMMARY OF THE INVENTION

According to the invention a wet mop is provided comprising an elongated mop handle having top and bottom ends; a plurality of fibrous strands comprising a mop body for cleaning a surface; means attaching the mop body to the mop handle bottom end; a sleeve in the form of a tubular shell, for squeezing water from the mop body by sliding the shell downward along the handle and over and around the mop body, axially and slidably mounted on the mop handle upward of the mop body; the tubular shell having an open lower end and a closed upper end; the tubular shell including a frusto conical shell portion tapering inwardly from about the shell lower end portion for at least a major portion of the shell length; the frusto conical shell portion having a group of axially positioned inwardly directed grooves equally spaced apart around the shell periphery; each groove of the group having a bottom, with the bottom of most of the grooves being substantially straight and parallel to the shell axis; and each groove of the group extending for at least a substantial portion of the frusto conical shell portion.

The shell tapered portion desirably begins at the lower end thereof so as to facilitate sliding the sleeve over the mop body.

The grooves can be defined by a pair of opposing slanted walls which intersect at an angle of about 60° to 120° and desirably 60° to 100°.

The depth of the grooves desirably decreases uniformly from their lower end to their upper end. Also, the width of the grooves desirably decreases uniformly from their lower end to their upper end.

The grooves desirably are positioned such that each groove is diametrically opposite another groove and the bottoms of each such pair of grooves are desirably linear and parallel to one another. The sleeve or tubular shell will generally have two to three pair of grooves. Also, all of the grooves may be substantially identical. Furthermore, the maximum depth of the grooves is suitably about 25 to 40% of the radial distance from the groove bottom to the shell axis.

The mop body can comprise a plurality of fibrous strands piled substantially one on another so as to extend out radially in substantially all horizontal directions and terminate in a circular pattern and with the mop body having a top surface and a bottom surface. An upper horizontal disc can be positioned in the central area of the mop body top surface; a lower horizontal disc can be positioned .in the central area of the mop body bottom surface; and suitable means can clamp the mop body between the upper and lower horizontal discs.

The lower horizontal disc can be circular and have a diameter up to about 55% of the distance between the bottoms of the opposing pairs of grooves. Also, the upper horizontal disc can be circular and have a diameter which is greater than 60% of the distance between the bottoms of the opposing pair of grooves.

The upper portion of the sleeve or tubular shell can be a circular cylindrical portion having an axial length up to about 45% of the length of the tubular shell; and the frusto conical portion and the cylindrical portion can smoothly merge together through a common circular shell portion. The grooves extend for most of the length of the frusto conical shell portion.

The lower end of the tubular shell can have a diameter of about 3 inches, the upper end of the shell can have a diameter of about 1.75 to 2 inches and the grooves can be about 0.35 to 0.5 inches deep. The tubular shell with such dimensions can be about 10.5 to 11.5 inches long but, of course, long enough to receive essentially all of the mop head. The presently preferred length is about 11 inches.

The lower horizontal disc can have a diameter of about 0.75 to 1 inch and the upper horizontal disc can have a diameter of about 1.4 to 1.75 inch.

A hand grip can be mounted on the handle above the sleeve and the hand grip can include sleeve securing means for holding the sleeve in stored position. The hand grip is desirably secured in place by expanding or exploding the handle outwardly beneath or inside the hand grip to thereby secure it in place by friction and slight physical deformation of the handle so as to avoid use of a mechanical fastener.

The sleeve or tubular shell closed upper end can include a cylindrical walled recess around the handle; the hand grip can have a lower end with a plurality of axial ribs spaced apart peripherally around the handle; and at least the ends of some of the ribs can fit in the cylindrical walled recess with a tight fit thereby releasably maintaining the sleeve in stored position.

The upper disc can be a generally parasol shaped member having a cap, a shaft can project axially outwardly from the cap and the cap can be wider than the shaft. The lower disc can constitute the head of a spool member and a cylindrical body can project axially outwardly from one side of the head. The spool member can have a hole extending axially inward from the head for receiving the parasol shaft in a telescoping close fit arrangement so that the cap and head can be positioned opposing each other to clamp the mop head therebetween. Locking means can be provided on the parasol shaped member for locking it to the spool member when the shaft is positioned in the hole. The hole can have an interior lateral profile essentially coinciding with the exterior lateral profile of the shaft. The locking means can include a catch means on the parasol shaped member shaft which engages with latch means on the spool member to thereby lock the parasol shaped member to the spool member.

The cap of the parasol shaped member can have at least one prong extending outwardly substantially normal to the cap and in the same direction as the shaft. Also, the spool member head can have at least one prong extending outwardly substantially normal to the spool head and in a direction opposite to the cylindrical body.

Desirably, the cap of the parasol shaped member has a plurality of prongs extending outwardly substantially normal to the cap and in the same direction as the shaft. Also, the spool member head can have a plurality of prongs extending outwardly substantially normal to the head and in a direction opposite to the cylindrical body. The prongs on the cap and on the head engage the mop body.

A connector element can be attached to the bottom end of the handle. The connector element can have a skirt extending outward from and be in axial alignment with the handle. The connector element skirt can be telescopically engaged with the spool member cylindrical body and means can be included to releasably secure the spool member and connector element together with the skirt and cylindrical body telescopically engaged.

The means releasably securing the spool member and connector element together when the skirt and cylindrical body are telescopically engaged can include a catch means and a latch means. One of the catch means and the latch means can be on the connector element and the other can be on the spool member and the catch means can engage with the latch means.

A collar can be slidably positioned on and around the handle above the connector element and the collar can have an internal lateral profile substantially coinciding with the size and shape of the connector skirt external profile so that the collar can be removably slid over the connector skirt to secure the latch means to the catch means.

DETAILED DESCRIPTION OF THE DRAWINGS

To the extent it is reasonable and practical the same or similar elements in the various views of the drawings will be identified by the same numbers.

Figure 1:
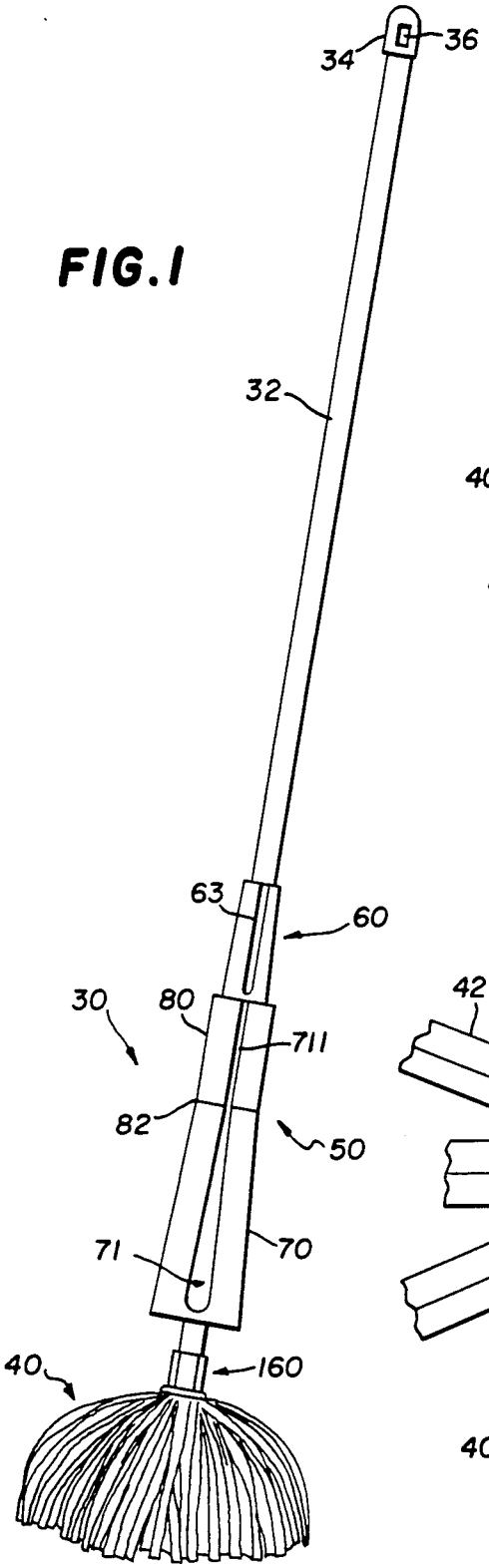
FIG. 1 is an isometric view of a wet mop according to the invention.
Figure 11:
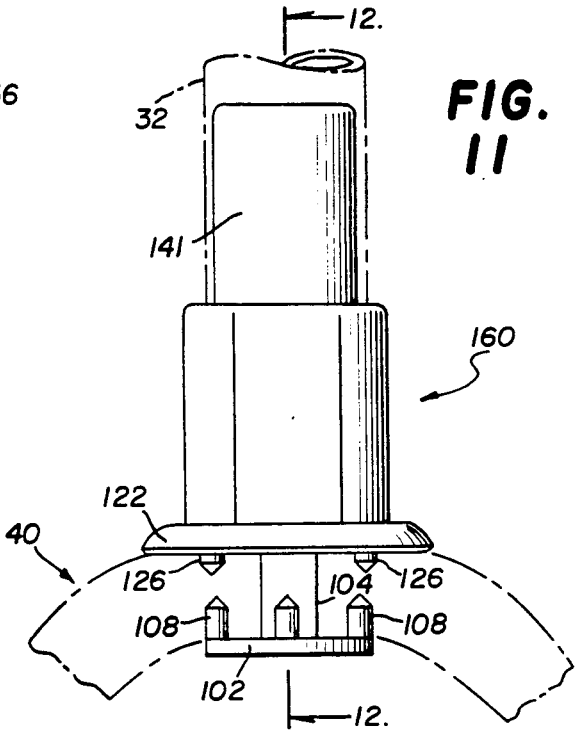
FIG. 11 is a side elevational view of the collar slid over the skirt of the connector element mounted to the lower end of the mop handle and with the mop head assembly removably attached to the connector.
Figure 10:
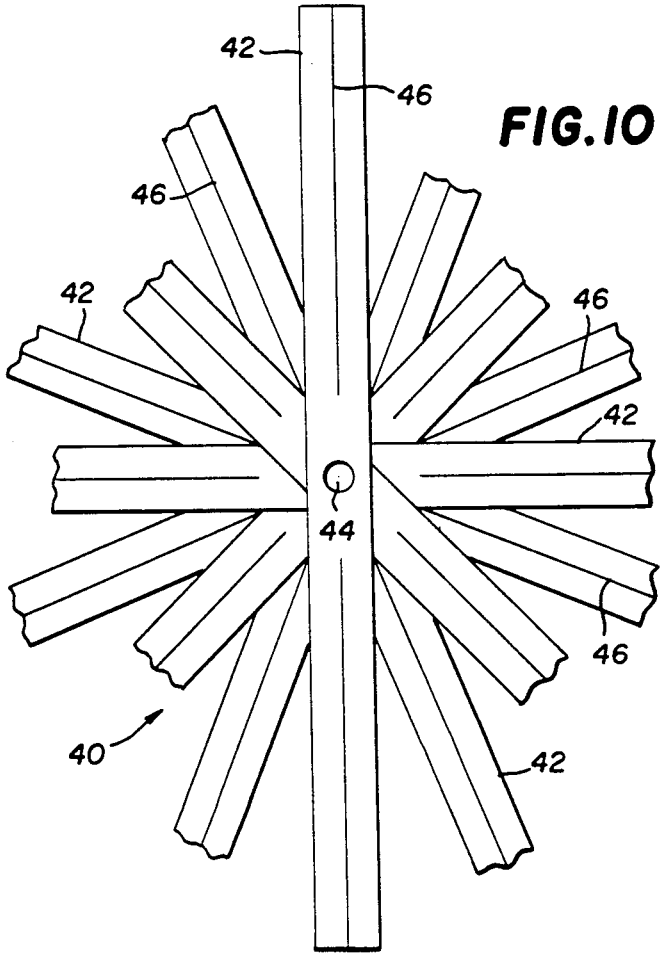
FIG. 10 is a plan view of a mop body made of one form of fibrous strand piled horizontally one upon another in diammetrical arrangement so as to extend out uniformly in substantially all radial directions.
Figure 2:
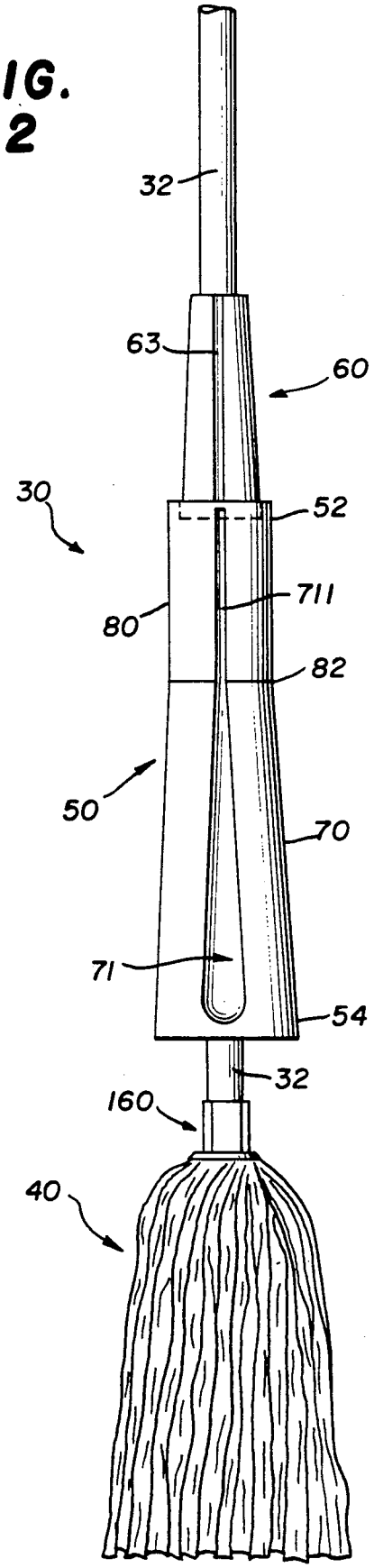
FIG. 2 is an elevational view of the lower one-half of the mop shown in FIG. 1 with the sleeve or tubular shell in stored position removably connected to the hand grip on the mop handle.
Figure 3:
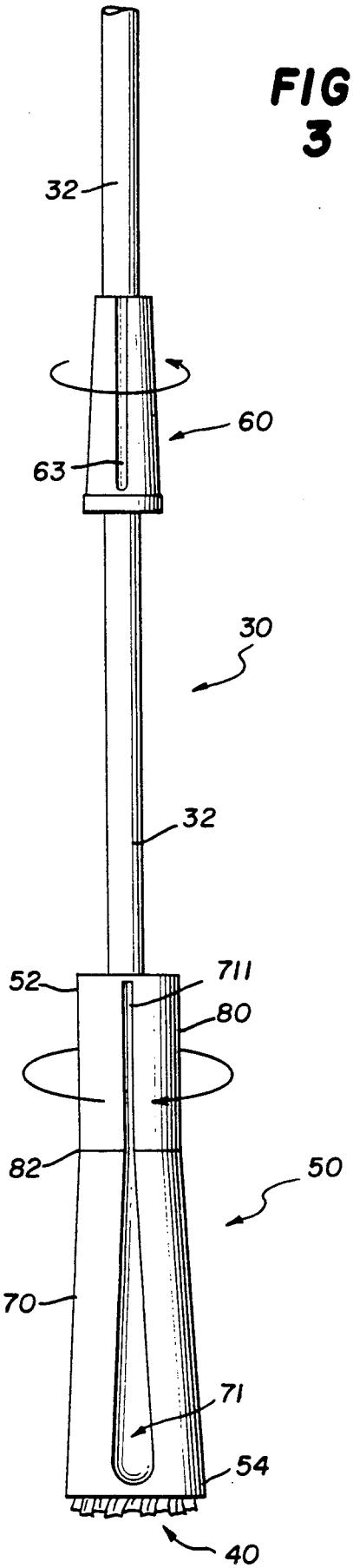
FIG. 3 is an elevational view of the mop illustrated by FIGS. 1 and 2 but with the sleeve slid over the mop body to wring water out of the mop body.

With reference to FIGS. 1 to 3, the wet mop 30 has a handle 32, which can be a lightweight metal tube, covered at the top by a hanging element 34 provided with a hole 36 sized to receive a hook.

The lower end of handle 32 has a removable mop head 40. Upwardly from the mop body 40 the sleeve 50 is slidably mounted on the handle 32. Hand grip 60 is securely mounted on handle 32 so that it cannot slide thereon. The hand grip can be placed in position on the handle and then the handle portion beneath the hand grip can be expanded or exploded outwardly so as to secure the hand grip on the handle. The hand grip 60 is located sufficiently high on the handle so that when the sleeve 50 upper end 52 engages the hand grip the lower end 54 of the sleeve 50 is positioned a short distance above the handle lower end so as to have it disengaged from the mop body and also so that it will not obstruct visability of the mop head in use (FIG. 2).

Figures 4, 5, 6, 7, 8, 9:
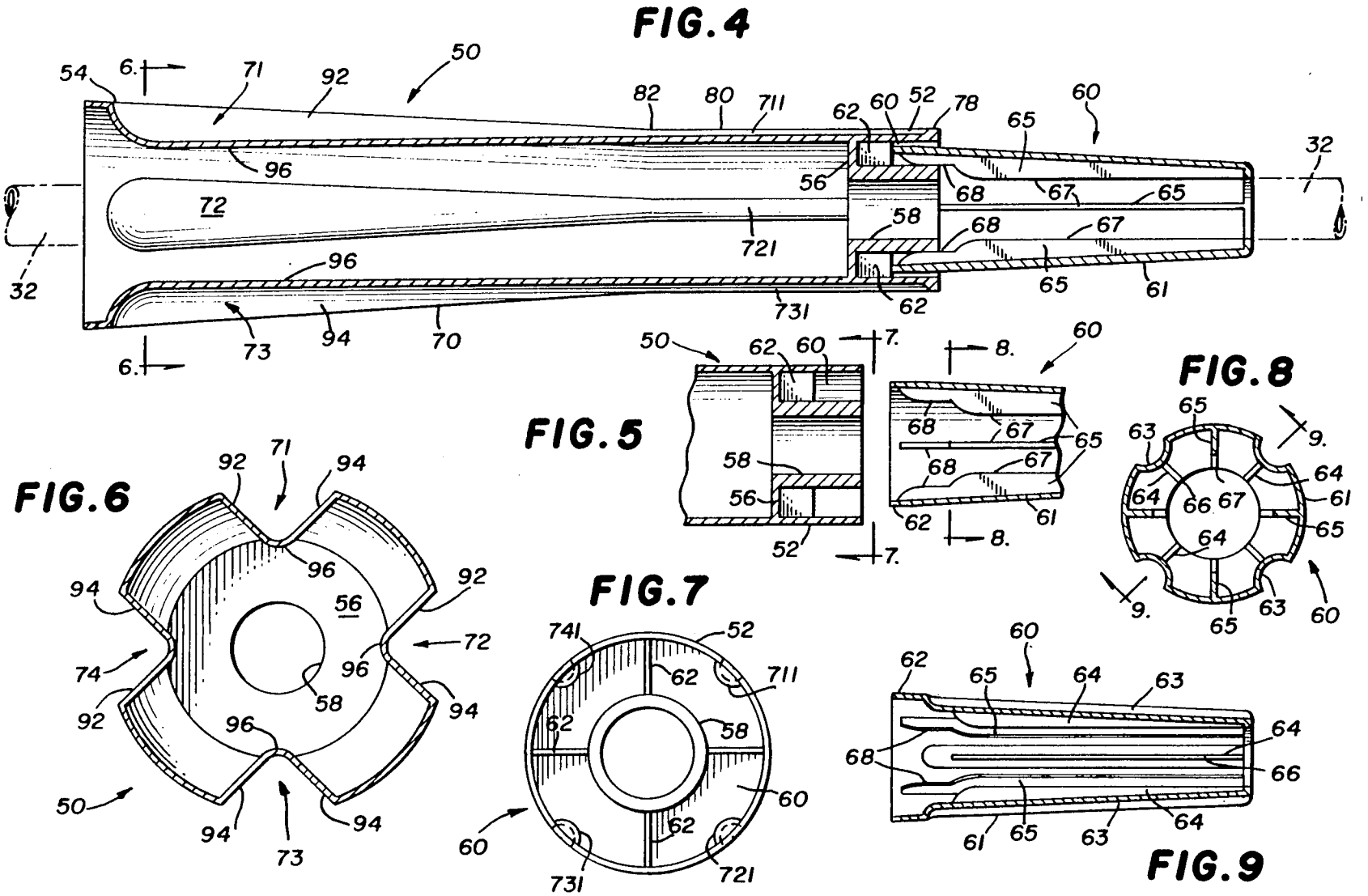
FIG. 4 is a longitudinal sectional view through the axis of the sleeve and the hand grip when the sleeve is in stored position as shown in FIG. 3.
FIG. 5 is an enlarged exploded view of the upper end of the sleeve and the lower end of the hand grip.
FIG. 6 is a lateral sectional view of the sleeve through the deepest portion of the grooves.
FIG. 7 is a view of the upper end of the sleeve taken along the line 7—7 of FIG. 5.
FIG. 8 is a lateral sectional view of the hand grip taken along the line 8—8 of FIG. 5.
FIG. 9 is a longitudinal sectional view taken along the line 9—9 of FIG. 8 through the axis of the hand grip.
Figure 12:
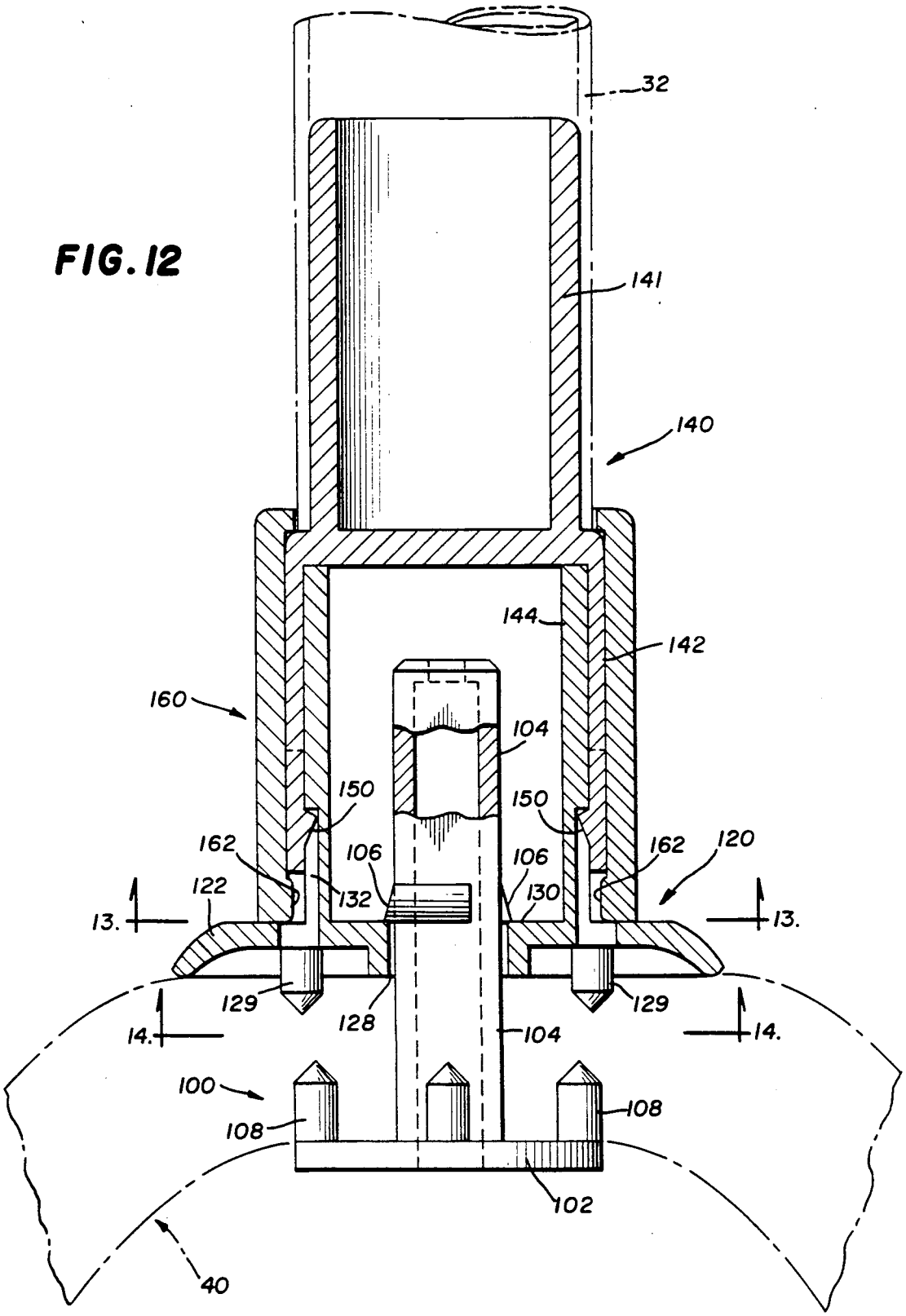
FIG. 12 is a longitudinal sectional view taken along the axial line 12—12 of FIG. 11.
Figure 13:
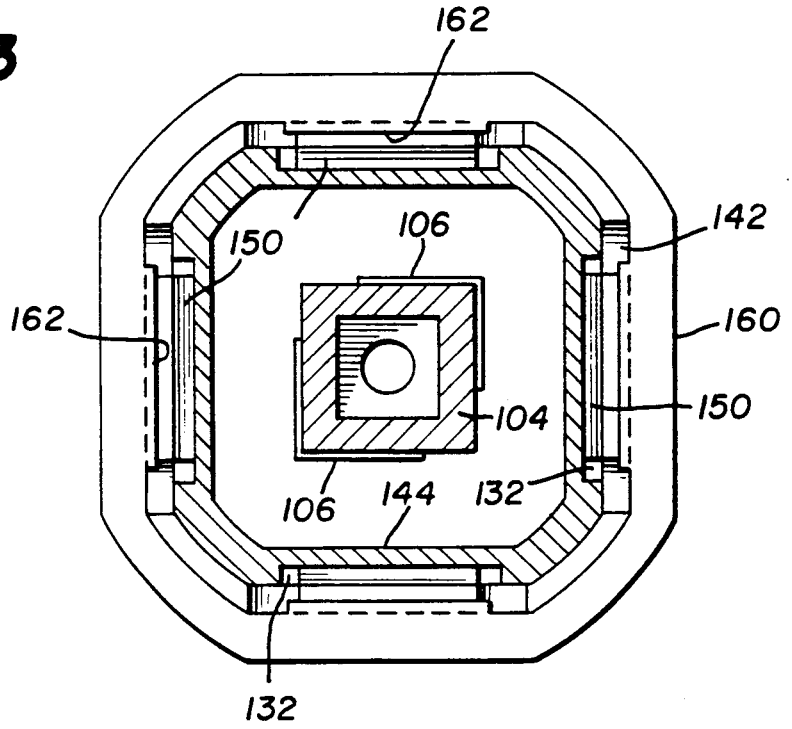
FIG. 13 is a sectional view taken along the line 13—13 of FIG. 12.
Figure 14:
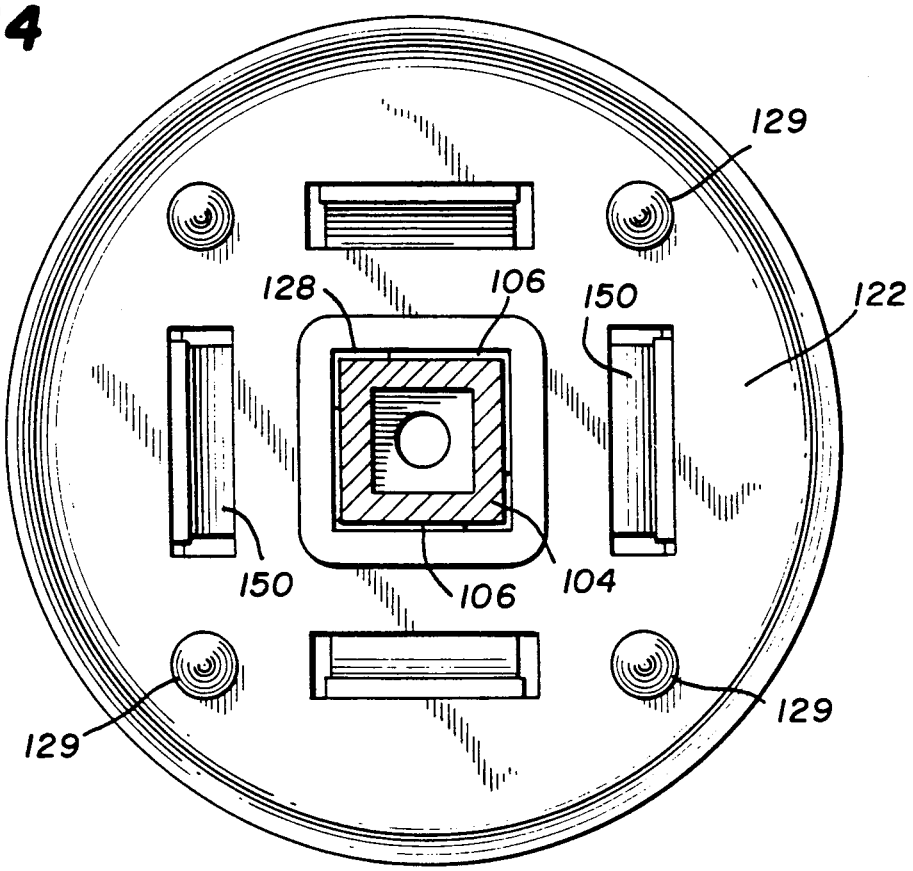
FIG. 14 is a bottom view of the parasol member taken along the line 14—14 of FIG. 12.
Figure 15:
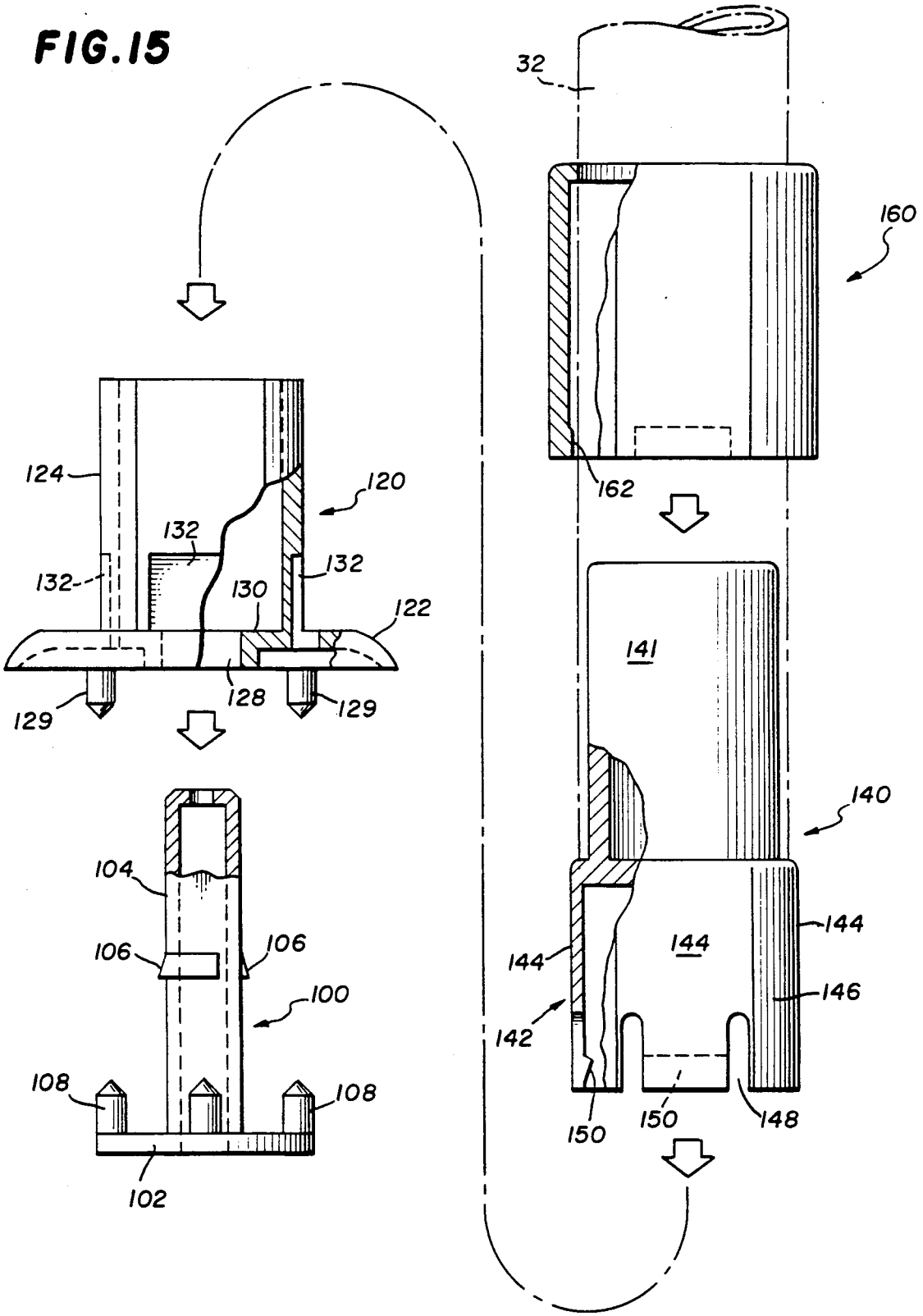
FIG. 15 is an exploded view illustrating the sequential bottom to top arrangement between the spool, the parasol, the connector and the collar.

FIGS. 4 to 6 illustrate the detailed structure of the sleeve 50. Sleeve 50 is a tubular shell, which can be molded in one piece from a suitable rigid tough polymeric material such as polypropylene. The sleeve lower end 54 is open while the upper end 52 is closed by an internal baffle 56 which supports cylindrical wall 58. The handle 32 fits in cylindrical wall 58 loosely so that sleeve 50 can slide axially on the handle. The wall 58 and the outer end 52 of the sleeve define a cylindrical recess 60. Four equally spaced apart axially located flanges 62 extend upwardly from baffle 56 (FIGS. 4, 5, 7) in cylindrical recess 60 for less than one-half of the recess axial depth.

The sleeve or tubular shell 50 has a frusto conical shell portion 70 having its geographical base at the shell lower end 54. The conical shell portion 70 tapers inwardly therefrom for at least a major portion of the total length of the sleeve or tubular shell 50. Desirably, the frusto conical shell portion is at least 55%, and desirably at least 65%, of the length of the sleeve 50. Since a practical overall length of the sleeve is about 10.5 to 11.5 inches, and desirably 11 inches, the length of the frusto conical portion 70 can be about 5.75 inches to 7.5 inches. It is to be understood, however, that the frusto conical portion can extend for substantially the entire length of the sleeve 50. Furthermore, it is considered most suitable for the taper to start at about the lower end of the sleeve and to continue upwardly therefrom in a uniform manner until it ends.

In a particularly useful form of sleeve, up to about 45% of the sleeve upper portion axial length can be a circular cylindrical portion 80 which desirably smoothly merges with the frusto conical portion through a common circular shell portion 82 (FIG. 4). The sleeve upper portion should be a maximum of two inches in diameter so as to permit it to be readily gripped by most persons, even those with small hands.

The frusto conical shell portion is provided with four identical axial grooves 71,72,73,74 equally spaced apart around the shell so that the first 71 and third 73 grooves constitute one opposing pair of grooves 71,73 and the second 72 and fourth 74 grooves constitute another pair 72,74 of grooves. It must be understood that the structures stated to be grooves have such appearance when the sleeve is viewed from the outside. When the sleeve is viewed from the inside the grooves appear as inwardly directed ribs defined by the groove walls and bottom.

The bottom 96 of each groove 71,72,73,74 is parallel with the longitudinal axis of the sleeve 50. The distance between the bottoms 96 of each opposing pair of grooves 71,73 and 72,74 is substantially the same as the diameter of the sleeve cylindrical portion 80. Further more, the bottoms of the grooves are desirably linear or straight and parallel to one another. Also, the grooves are desirably longitudinally symmetrical with respect to a plane lying in the plane of the sleeve axis and the groove bottom longitudinal line.

The grooves 71,72,73,74 can be about 0.35 to 0.5 inches deep at their deepest point and they can be about 0.65 to 0.9 inches wide at their widest point. The maximum depth of the grooves will generally be about 25 to 40% of the radial distance from the groove bottom to the shell axis.

While the grooves can be arcuate in lateral section it is generally desirable for the grooves to be defined by a pair of opposing slanted walls 92,94 which intersect at an angle of about 60° to 120°, and preferably 60° to 100° (FIG. 6). Since the grooves 71,72,73,74 are located in the frusto conical portion 80 of the sleeve 50, and because the bottoms of the grooves are parallel to the sleeve axis, the depth of the grooves will decrease uniformly from their lower end to their upper end. Similarly, the width of the grooves decreases uniformly from their lower end to their upper end.

The grooves 71,72,73,74 are shown in the drawings to extend for essentially the entire length of the cylindrical portion 80 but they terminate just before the upper edge 78 (FIG. 4) of the sleeve. However, these groove extensions 711,721,731,741 in the cylindrical portion are very shallow and will generally be no more than about 0.16 inch deep. These shallow groove extensions are included primarily for ascetic reasons and to facilitate molding the sleeve.

A specific sleeve or tubular shell 50 can be about 11 inches long, have an open lower end with an inside diameter of about 3 inches, an upper end with an inside diameter of about 1.75 to 2 inches, a maximum groove depth of about 0.5 inch and symmetrical groove walls angled to 90°. The diametrical distance between the bottoms of opposing grooves can be about 2 inches.

The hand grip 60 (FIGS. 4,5,8,9) includes a frusto conical shell 61 which is open at both ends and which has its base or larger circular end 62 directed downwardly toward the upper end of sleeve 50. Four equally spaced apart longitudinal grooves 63 are provided in hand grip shell 61. The grooves 63 are positioned axial to the shell axis.

A radially inwardly directed rib 64 is located on each of the four grooves 63. The distance between the terminal parallel edges 66 of each pair of opposing ribs 64 is slightly less than the thickness of the mop handle 32 so that the hand grip can be slid onto the handle and be held firmly in place by expanding the handle from within. This avoids use of a fastener. The hand grip 60 also has four additional radially inwardly directed axially located and equally spaced apart ribs 65. The ribs 65 are positioned such that one rib 65 is located between two ribs 64. The ribs 65 terminate in straight edges 67 parallel to the hand grip 60 longitudinal axis. The distance between each pair of diametrical edges 67 is slightly less than the thickness of handle 32 so that when the hand grip is slid onto the handle the hand grip is further held in place by the resulting additional friction.

The axially lower most portion of the ribs 65 of the hand grip 60 terminate in an edge 68 parallel to the hand grip axis. The edges 68 of each pair of opposing ribs are diametrically spaced apart a distance slightly less than the outer diameter of cylindrical wall 58. As a result, when the sleeve 50 is slid upwardly on the handle 32 the cylindrical wall 58 slides inside the eges 68 and provides a moderate gripping action which thereby holds the sleeve in stored position so that the mop body can be used in mopping a surface without the sleeve interfering.

The mop body 40 can be made of a plurality of identical longitudinal flat strands 42 having a centrally located hole 44. Each strand 42 is desirably slit 46 inwardly from each end for at least 90% of the distance from a respective end to the hole 44 thereby effectively doubling the number of strands which can provide a mopping action. About eighteen strands 42 can be assembled into a suitable mop head. Such strands can have the same length and be about 18 to 19 inches long and 1.5 inches wide. The strands are desirably made of a highly water absorbing nonwoven fibrous material about 0.15 inch thick in its noncompressed state. The strands are arranged diametrically one above the other in the form of a circle with the holes 44 axially aligned vertically. Each strand can be arranged in a clockwise angular direction about 20° forward of the strand just below it although other angular arrangements can be used to distribute the strands in a substantially uniform circular pattern.

The mop head 40 comprising the mass of strands 42 is held together as a mop head assembly by a lower disc comprising the cap 102 of a generally parasol shaped member 100 and an upper disc comprising the head 122 of a spool member 120 (FIGS. 12 to 15).

The cap 102 of parasol shaped member 100 has a shaft 104 projecting axially outwardly from one side of the cap. The shaft 104 as shown in the drawings is square in lateral section and has a catch means 106, on the adjacent sides of opposing edges, in the form of ridges. Four upwardly projecting equally spaced apart prongs 108 are positioned on the edge of head 102. The prongs 108 extend outwardly substantially normal to cap 102. The shaft 104 is sized to fit in the holes 44 in the strands 42.

The spool member 120 has a hollow cylindrical circular body 124 which projects axially outwardly from the upper side of head 122. The diameter of head 122 is made as small as possible since the smaller it is the smaller the inside diameter of the sleeve can be. By reducing the diameter of the sleeve the amount of water which can be squeezed out increases so that the dry mopping action of the mop is more efficient. A square hole 128 is centrally or axially positioned in head 122 and it is sized to receive parasol shaft 104 in a telescoping close fit arrangement. Head 122 is provided with four prongs 129 extending outwardly substantially normal to the head and in a direction opposite to the cylindrical body 124. The four prongs 129 are equally spaced apart.

The holes 44 in strands 42 are sized to receive shaft 104 in a snug fit. After all the strands are threaded onto shaft 104, the shaft 104 is directed into hole 128 in spool head 122. The spool 120 and parasol shaped member 100 are then pressed together until the catch means 106 is forced through hole 128 until it passes the upper surface 130 of head 122 and thereby prevents reverse movement out of the hole. The upper surface 130 thus functions as a latch means which is engaged by the catch means 106, the result being that the two function as a locking means holding the spool, parasol and mop body together as a mop head assembly. The prongs 108 and 129 engage with the mop strands and keep them in position.

The bottom end of mop handle 32 has a connector element 140 attached to it. The connector element 140 has a tubular upper end 141 which fits tightly and permanently into the hollow bottom end of the handle. The connector element 140 also includes a skirt 142 extending outward from and in axial alignment with the handle 32. The skirt 142 has four major sides 144, which are comparable to the sides of a square block, and four minor sides 146 which are comparable to the sides formed by cutting off the four corner edges of a square block. Each major side 144 has a pair of spaced apart cut out slits 148 extending inwardly or upwardly from the bottom edge of the skirt. These slits permit the lower portion of the major wall sides 144 to flex or bend more readily. The inner surface of each major side 144 has an inwardly directed tooth 150 which is as wide as the distance between two slits 148.

The connector skirt 142 fits telescopically over the spool member cylindrical body 124 and when so positioned the teeth 150 fit into respective recesses 132. However, the connector skirt 142 can be readily withdrawn from the spool by pulling each of these members in opposite directions since the teeth will ride out of the recesses 32 through flexing of the lower portion of each major side 144 unless restrained by collar 160. The teeth 150 constitute a catch means and the surface 130 constitutes a latch means.

The collar 160 is slidably positioned on and around handle 32 above the connector 142 but below the sleeve. The collar 160 has an internal lateral profile substantially coinciding with the size and shape of the connector skirt external profile so that the collar can be removably slid over the connector skirt to force each of the teeth 150 into a respective recess 132 and prevent the teeth from riding out of the recesses except after the collar is slid upwardly off the skirt. The collar 160 specifically has four major sides like a square with the vertical corner edges rounded or cut back. The lower internal surface of each major side has a bar 162 which goes past the bottom portion of skirt 142 and past teeth 150 to help hold the collar from riding up.

The described mop head assembly is readily replaceable after it becomes worn or unusable for any reason by sliding collar 160 upwardly and then pulling the mop head assembly downwardly while pulling the mop handle upwardly. The old mop head assembly can be discarded and a new replacement mop head assembly attached by reversing the procedure.

The described structure of sleeve 50 makes it highly efficient for squeezing or wringing water from mop body 40. By having the sleeve taper outwardly to about at the lower end thereof it is easier to slide the sleeve over the mop head than would be the case if the lower end were cylindrical as in the mop of DE 3607121 A1 cited above.

When the sleeve is first slid axially downwardly over mop body 40, the mass of strands 42 is squeezed together and water drains off their ends. If it is desired to damp mop a surface, the sleeve can be slid upwardly into stored position and the mop body used with the residual water in the strands. However, for efficient drying of a surface, additional water can be removed before retracting the sleeve into stored position. Thus, the sleeve can be turned clockwise with the left hand while turning the hand grip counterclockwise with the right hand. Of course, a left handed person would likely prefer to reverse the described gripping positions. By rotating the sleeve about 90° with respect to the hand grip, additional quantities of water are squeezed free and drain out of the lower end of the sleeve. The described rotation results in a twisting of the strands in the sleeve. The lower portion of the mass of mop body strands is held largely stationary by pressing against the grooves 71. This pressing action results in water being squeezed free. Additionally, while the lower portion of the mop body remains stationary, the upper portion of the mop body is twisted or wrung about 90° since the mop body upper portion is restrained against turning to only a very limited extent since the upper portion of the grooves are much shallower than the lower portion.

Other structural features which lead to high water removal from the mop body is the ratio of the depth of the grooves to the diameters of the frusto conical portion of the sleeves and the distance between the bottoms of opposing pairs of grooves. By having the groove bottoms straight and parallel to the sleeve axis, further efficient removal of water is obtained. The described proportions and ratios for cap 102 and head 122 also contribute to efficient water removal and easy sliding of the sleeve over the mop body and its subsequent retraction therefrom. By having head 122 larger than cap 102, the strands 42 are caused to drape downwardly better thereby permitting the sleeve to slide over the mass of strands with ease, particularly when wet or damp. Also, since the head 122 is larger, it acts like a back-up plunger baffle and pushes the mop body out of the sleeve without the strands folding back upon themselves.

The foregoing detailed description has been given for clearness of understanding only, and no unnecessary limitations should be understood therefrom, as modifications will be obvious to those skilled in the art.

What is claimed is:

1. A mop comprising:
an elongated mop handle having top and bottom ends;
a plurality of fibrous strands comprising a mop body for cleaning a surface;
means attaching the mop body to the mop handle bottom end;
a sleeve in the form of a tubular shell, for squeezing water from the mop body by sliding the shell downward along the handle and over and around the mop body, axially and slidably mounted on the mop handle upward of the mop body;
the tubular shell having an open lower end and a closed upper end;
the tubular shell including a frusto conical shell portion tapering inwardly from the shell lower end portion for at least a major portion of the shell length;
the frusto conical shell portion having a group of axially positioned inwardly directed grooves equally spaced apart around the shell periphery;
each groove of the group having a bottom, with the bottom of the groove being straight for its length and parallel to the shell axis;
each groove of the group extending for at least nearly the entire length of the frusto conical shell portion;
the grooves being positioned such that each groove is diametrically opposite another groove;
the bottoms of each opposing pair of grooves being parallel to one another;
the depth of the grooves decreasing uniformly from their lower end to their upper end; and
the width of the grooves decreasing uniformly from their lower end to their upper end.

2. A mop according to claim 1 in which:
the grooves are defined by a pair of opposing slanted walls which intersect at an angle of about 60° to 120°.

3. A mop according to claim 2 in which:
the grooves are defined by a pair of opposing slanted walls which intersect at an angle of about 60° to 100°.

4. A mop according to claim 1 in which:
the shell has two to three pair of grooves;

5. A mop according to claim 1 in which:
all of the grooves are substantially identical.

6. A mop according to claim 5 in which:
the maximum depth of the grooves is 25 to 40% of the radial distance from the groove bottom to the shell axis.

7. A mop according to claim 1 in which:
the lower end of the shell has a diameter of about 3 inches, the upper end of the shell has a diameter of about 1.75 to 2 inches and the grooves are about 0.35 to 0.5 inches deep.

8. A mop according to claim 1 in which:
a hand grip is mounted on the handle above the sleeve; and
the hand grip includes sleeve securing means for holding the sleeve in stored position.

9. A mop comprising:
an elongated mop handle having top and bottom ends;
a plurality of fibrous strands comprising a mop body for cleaning a surface;
the plurality of fibrous strands being piled substantially one on another so as to extend out radially in substantially all horizontal directions and terminate in a circular pattern and with the mop body having a top surface and a bottom surface;
an upper horizontal disc positioned in the central area of the mop body top surface;
a lower horizontal disc positioned in the central area of the mop body bottom surface;
means clamping the mop body between the upper and lower horizontal discs;
means attaching the mop body to the mop handle bottom end;
a sleeve in the form of a tubular shell, for squeezing water form the mop body by sliding the shell downward along the handle and over and around the mop body, axially and slidably mounted on the mop handle upward of the mop body;
the tubular shell having an open lower end and a closed upper end;
the tubular shell including a frusto conical shell portion tapering inwardly from about the shell lower end portion for at least a major portion of the shell length;
the frusto conical shell portion having a group of axially positioned inwardly directed grooves equally spaced apart around the shell periphery;
each groove of the group having a bottom, with the bottom of most of the grooves being substantially straight and parallel to the shell axis; and
each groove of the group extending for at least a substantial portion of the frusto conical shell portion.

10. A mop according to claim 9 in which:
the lower horizontal disc is circular and has a diameter up to about 55% of the distance between the bottoms of the opposing pairs of grooves.

11. A mop according to claim 10 in which:
the upper horizontal disc is circular and has a diameter which is greater than 60% of the distance between the bottoms of the opposing pair of grooves.

12. A mop according to claim 9 in which:

the lower disc is a generally parasol shaped member having a cap and a shaft projects axially outwardly from the cap an the cap is wider than the shaft;

the upper disc constitutes the head of a spool member and a cylindrical body projects axially outwardly from one side of the head;

the spool member has a hole extending axially inward from the head for receiving the parasol shaft in a telescoping close fit arrangement so that the cap and head can be positioned opposing each other to clamp an object therebetween; and locking means is provided on the parasol shaped member for locking it to the spool member when the shaft is positioned in the hole.

13. A mop according to claim 12 in which:

the cap of the parasol shaped member has at least one prong extending outwardly substantially normal to the cap and in the same direction as the shaft.

14. A mop according to claim 12 in which:

the spool member head has at least one prong extending outwardly substantially normal to the head and in a direction opposite to the cylindrical body.

15. A mop according to claim 12 in which:

the hole has an interior lateral profile essentially coinciding with the exterior lateral profile of the shaft.

16. A mop according to claim 12 in which:

the locking means includes a catch means on the parasol shaped member shaft which engages with latch means on the spool member to thereby lock the parasol shaped member to the spool member.

17. A mop according to claim 16 in which:

the cap of the parasol shaped member has a plurality of prongs extending outwardly substantially normal to the cap and in the same direction as the shaft;

the spool member head has a plurality of prongs extending outwardly substantially normal to the head and in a direction opposite to the cylindrical body; and the prongs on the cap and on the head engage the mop body.

18. A mop according to claim 12 comprising:

a connector element attached to the bottom end of the handle;

the connector element having a skirt extending outward from and in axial alignment with the handle;

the connector element skirt being telescopically engaged with the spool member cylindrical body; and means releasably securing the spool member and connector element together with the skirt and cylindrical body telescopically engaged.

19. A mop according to claim 18 in which:

the means releasably securing the spool member and connector element together when the skirt and cylindrical body are telescopically engaged includes a catch means and a latch means;

one of the catch means and the latch means is on the connector element and the other is on the spool member; and the catch means engages with the latch means.

20. A mop according to claim 19 in which:

a collar is slidably positioned on and around the handle above the connector element; and the collar has an internal lateral profile substantially coinciding with the size and shape of the connector skirt external profile so that the collar can be removably slid over the connector skirt to secure the latch means to the catch means.

21. A mop comprising:

an elongated mop handle having top and bottom ends;

a plurality of fibrous strands comprising a mop body for cleaning a surface;

means attaching the mop body to the mop handle bottom end;

a sleeve in the form of a tubular shell, for squeezing water from the mop body by sliding the shell downward along the handle and over and around the mop body, axially and slidably mounted on the mop handle upward of the mop body;

the tubular shell having an open lower end and a closed upper end;

the tubular shell including a frusto conical shell portion tapering inwardly from about the shell lower end portion for at least a major portion of the shell length;

the frusto conical shell portion having a group of axially positioned inwardly directed grooves equally spaced apart around the shell periphery;

each groove of the group having a bottom, with the bottom of most of the grooves being substantially straight and parallel to the shell axis;

each groove of the group extending for at least a substantial portion of the frusto conical shell portion;

a hand grip mounted on the handle above the sleeve;

the sleeve closed upper end including a cylindrical walled recess around the handle;

the hand grip having a lower end with a plurality of axial ribs spaced apart peripherally around the handle; and the ribs fitting in the cylindrical walled recess with a tight fit thereby releasably maintaining the sleeve in stored position.

* * * * *

UNITED STATES PATENT AND TRADEMARK OFFICE

CERTIFICATE OF CORRECTION

PATENT NO. : 5,060,338

DATED : October 29, 1991

INVENTOR(S) : YATES ET AL

It is certified that error appears in the above-identified patent and that said Letters Patent is hereby corrected as shown below:

Column 5, lines 35 and 48, after "portion" insert -- 70 --, line 63, change "Further" to -- Further- --; column 6, line 12, change "80" to -- 70 --, line 64, change "eges" to -- edges --; column 10, line 41, change "form" to -- from --; column 11, line 3, change "an" to -- and --.

Signed and Sealed this

Twentieth Day of April, 1993

*Attest:*

MICHAEL K. KIRK

*Attesting Officer*

*Acting Commissioner of Patents and Trademarks*